US005342219A

United States Patent [19]

Onodera et al.

[11] Patent Number: 5,342,219

[45] Date of Patent: Aug. 30, 1994

[54] TERMINAL-LOCKING CONSTRUCTION

[75] Inventors: Shinya Onodera, Tokyo; Toshiharu Kawashima, Shizuoka, both of Japan

[73] Assignee: Yazaki Corporation, Tokyo, Japan

[21] Appl. No.: 28,195

[22] Filed: Mar. 9, 1993

[30] Foreign Application Priority Data

Mar. 10, 1992 [JP] Japan ..... 4-011817[U]
Mar. 11, 1992 [JP] Japan ..... 4-012049[U]

[51] Int. Cl.[5] ..... H01R 13/40
[52] U.S. Cl. ..... 439/595; 439/861
[58] Field of Search ..... 439/595, 685, 740, 861

[56] References Cited

U.S. PATENT DOCUMENTS 3,514,745 5/1970 De Leon .
4,690,478 9/1987 Rahrig et al. ..... 439/595 X

FOREIGN PATENT DOCUMENTS 59-103382 7/1984 Japan .

*Primary Examiner*—Eugene F. Desmond
*Attorney, Agent, or Firm*—Finnegan, Henderson, Farabow, Garrett & Dunner

[57] ABSTRACT

A housing has a groove-like terminal-receiving cavity. The terminal-receiving cavity receives a female terminal therein. The female terminal has a first engagement portion at a longitudinal end thereof and a second engagement portion at a longitudinally intermediate position thereof. The terminal-receiving cavity is formed with a third engagement portion therein at one longitudinal end thereof, the third engagement portion engaging the first engagement portion when the terminal is fully inserted into the terminal receiving cavity. The terminal-receiving cavity is formed with a fourth engagement portion at a longitudinally intermediate position thereof, the fourth engagement portion engaging the second locking portion when the terminal is fully inserted into the terminal receiving cavity. When assembling the terminal into the terminal-receiving cavity, the first engagement portion of the terminal is first engaged the third engagement portion and thereafter the terminal is pivotally rotated about an engagement between the first and third engagement portions into the terminal-receiving cavity unit the second engagement portion firmly engages the fourth engagement portion.

13 Claims, 11 Drawing Sheets

TERMINAL-LOCKING CONSTRUCTION

BACKGROUND OF THE INVENTION

1. Field of the Invention

The present invention relates to construction where terminals are locked into a terminal-receiving cavities of a connector housing.

2. Prior Art

FIG. 12 shows a prior art connector as disclosed in Japanese Utility Model Preliminary Publication No. 59-103382. In FIG. 12, a connector housing a includes a terminal-receiving cavity b extending in the direction in which the connector is inserted into the mating connector housing not shown. The terminal-receiving cavity b is provided with a resilient locking arm c and a stopper d therein. A bottom wall e is formed with an insertion hole g therein through which a male terminal f of the mating connector is to be fitted. A female terminal h has a female electrical contact hi and a crimp barrel h2.

As shown in FIG. 13, the female terminal h, which has the crimp barrel h2 connected to a wire i, is inserted from the rear of the housing into the terminal-receiving cavity b until the terminal abuts the stopper d. When the female terminal h has been fully inserted into the cavity, the resilient locking arm c engages the end portion of the female electrical contact h1 to prevent the terminal from being pulled out of the connector. With this prior art construction, the overall height of the connector is the sum of the height L of the female terminal h, the height L2 of the bottom wall e, and the height L3 of the upper wall which includes the deflection space C1 of the resilient locking arm c. Therefore, the only way of further miniaturizing the connector is to reduce these dimensions. However, each element must have a certain thickness for sufficient mechanical strength. Thus, this prior art construction places difficulty in further miniaturizing the connector.

FIGS. 14A and 14B show a conventional male terminal m inserted into a female terminal for electrical contact. In the Figures, the female electrical contact has a folded resilient contact k. The male terminal m is inserted into the terminal-receiving cavity for electrical contact with the folded resilient contact k. If the male terminal m is tilted as shown in FIG. 14B, then the resilient contact k is subjected to excessive deformation and may lose resiliency thereof.

SUMMARY OF THE INVENTION

An object of the present invention is to provide improved terminal-locking construction used for a miniaturized connector housing. A further object of the invention is to provide improved terminal-locking construction in which a male terminal is prevented from rocking motion so that the female resilient electrical contact in contact with the male terminal is not excessively deformed due to rocking motion of the male terminal.

The construction according to the present invention includes a housing having a groove-like terminal-receiving cavity. A female terminal is retained within the terminal-receiving cavity, the female terminal having a first engagement portion (12) at a longitudinal end thereof and a second engagement portion (13) at a longitudinally intermediate position thereof. The terminal-receiving cavity is formed with a third engagement portion (5) at one longitudinal end thereof, the third engagement portion engaging the first engagement portion when the female terminal is fully inserted into the terminal receiving cavity. The terminal-receiving cavity is formed with a fourth engagement portion (6) at a longitudinally intermediate position thereof, the fourth engagement portion engaging the second engagement portion when the terminal is fully inserted into the terminal-receiving cavity.

When assembling the female terminal into the terminal-receiving cavity, the first engagement portion of the terminal first engages the third engagement portion and thereafter the female terminal is pivotally rotated about an engagement between the first and third engagement portions into the terminal-receiving cavity until the second engagement portion firmly engages the fourth engagement portion (6).

The terminal-receiving cavity includes a bottom wall with a first hole (4) formed therein and the female terminal further includes a second hole (15) therein through which the male terminal extends while being in contact with the female terminal, whereby the male terminal is held both at the first hole and at the second hole.

BRIEF DESCRIPTION OF THE DRAWINGS

Features and other objects of the present invention will become more apparent from the description of the preferred embodiments with reference to the accompanying drawings in which.

DETAILED DESCRIPTION OF THE INVENTION

Construction

Figure 1A:
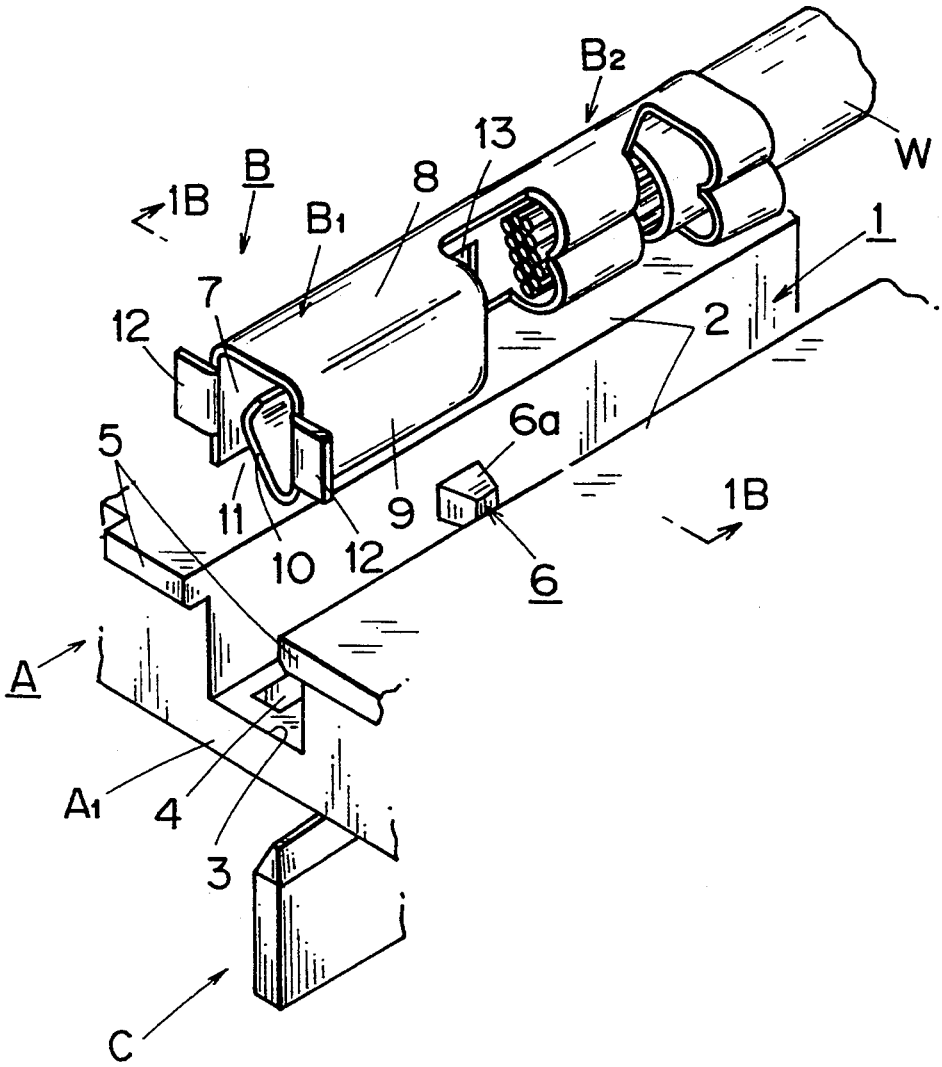
FIG. 1A is a fragmentary perspective view of a female connector according to the present invention, showing a female terminal B and a male terminal C.
Figure 2:
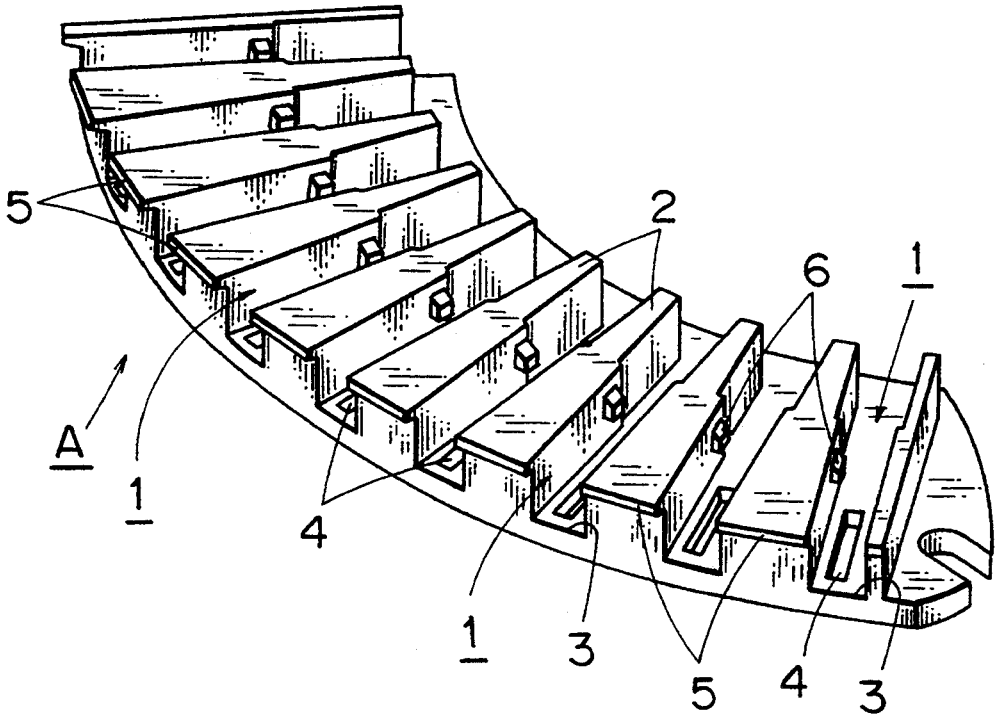
FIG. 2 is a general perspective view of the housing in FIG. 1.
Figure 3A:
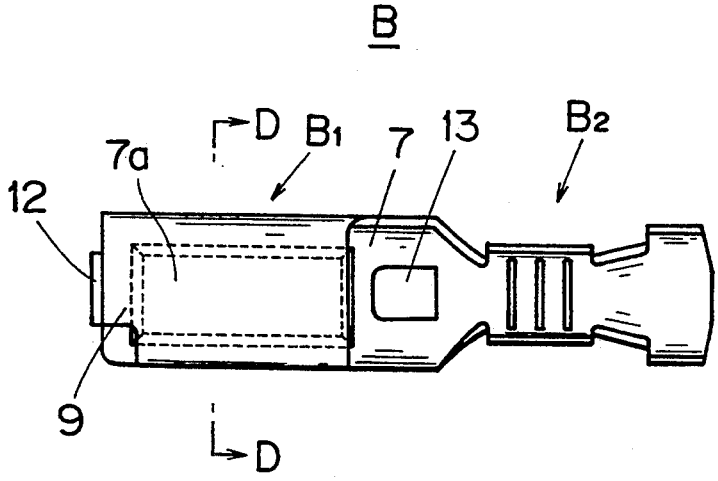
FIG. 3A is a side view of the female terminal B of FIG. 1, FIG. 3B being a bottom view thereof, and FIG. 3C being a cross-sectional view thereof.

FIG. 1A shows a connector mounted to an inhibiter switch unit used for a transmission of an automotive vehicle. FIG. 2 shows a general view of the housing A. FIG. 3A is a side view of the female terminal B of FIG. 1 and FIG. 3B is a bottom view of the female terminal B.

As shown in FIG. 2, the connector is comprised of a housing A in the form of a generally fiat shape formed of resin, female terminals B, and male terminals C. The housing A is formed with a plurality of groove-like terminal-receiving cavities disposed side-by-side in an arcuate shape as a whole. The groove-like terminal-receiving cavity 1 is defined by opposing side walls 2 and a bottom wall 3. Adjacent terminal-receiving cavities are partitioned by the side walls 2. The bottom wall 3 of the respective terminal-receiving cavity 1 is formed with an opening 4 therein through which a male terminal of the mating connector is inserted into the female terminal. As shown in FIG. 1, the terminal-receiving cavity 1 is provided with a projection 5 at the end thereof. A projection 6 projects from one of the opposing side walls 2 into the terminal-receiving cavity 1 and has beveled walls **6*a*** which will be described later.

Figure 1B:
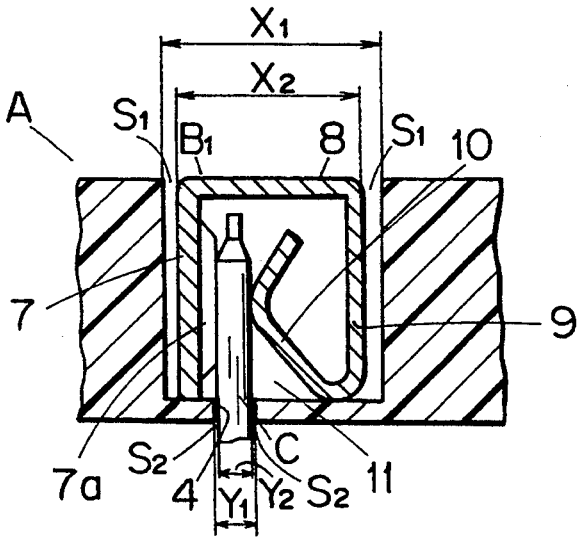
FIG. 1B is a cross-sectional view of the female connector in FIG. 1A when the male terminal is fully inserted thereinto.

FIG. 1B is a cross-sectional view taken along the lines 1B—1B of FIG. 1A, and shows the male terminal C when fully inserted into the female connector. The terminal-receiving cavity 1 has a width X1 slightly wider than the width X2 of the female electrical contact B1, leaving gaps S1. The opening 4 has a width Y1 slightly wider than the thickness Y2 of the male terminal C, leaving gaps S2. The gap S1 is greater than the gap S2. The gaps S1 and S2 allow the female terminal B and the male terminal C, respectively, to slightly move to absorb dimensional errors of female and male terminals so that the male terminal C is smoothly inserted into the female terminal B.

Figure 3B:
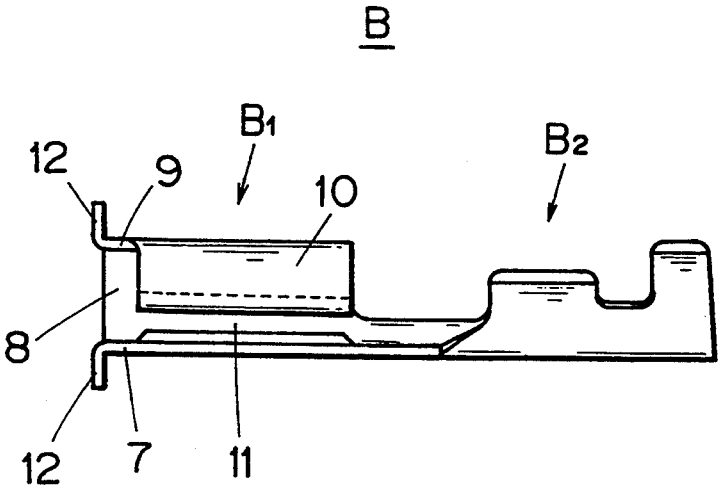
Figure 3C:
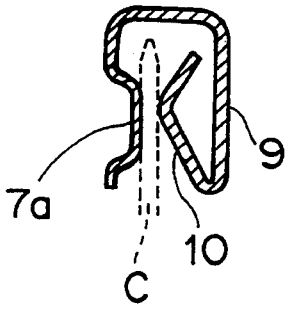

As shown in FIGS. 3A and 3B, the female terminal B has a female electrical contact B1 and a crimp barrel B2. The female electrical contact B1 includes a base 7 and an opposing portion 9 integrally continuous with the base 7 via a portion 8. A contact 10 is folded over the inner surface of the opposing portion 9 to form a male-terminal-receiving space 11 into which the male terminal is to be inserted. The base 7 and the opposing portion 9 have flanges 12 at their front ends, which flanges extend in a direction away from each other. The female terminal B is provided with a lock hole 13 between the electrical contact B1 and the crimp barrel B2.

Figure 4A:
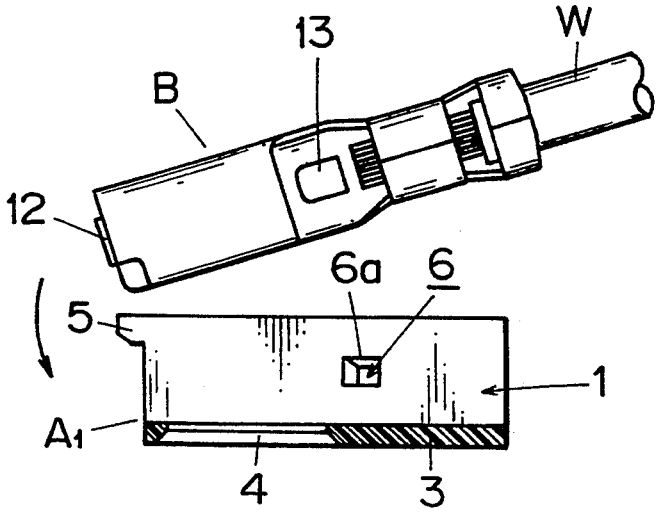
FIGS. 4A–4C show the assembly procedure for assembling the female terminal B into the housing.
Figure 4B:
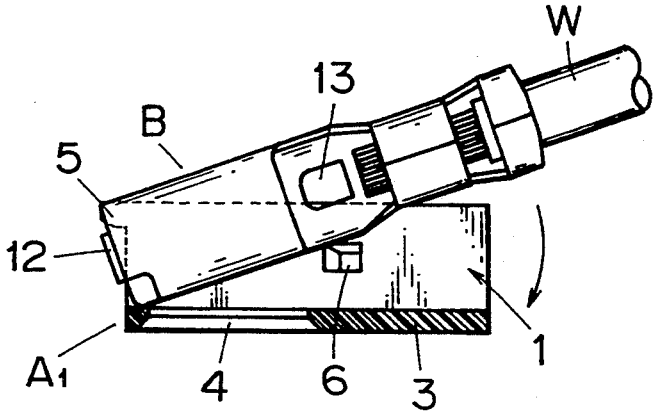
Figure 4C:
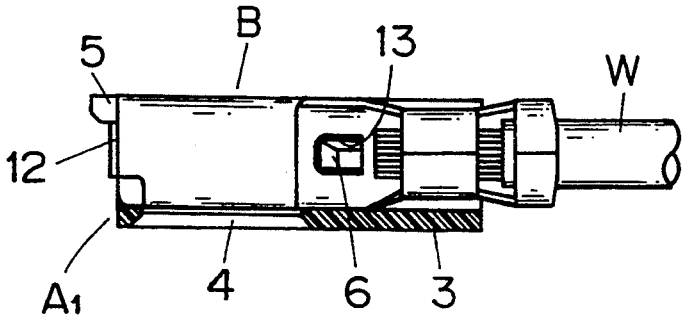

FIGS. 4A–4C show the procedure for assembling the female terminal B into the housing A. The female terminal B having the wire W crimped thereto, is first positioned above the terminal-receiving cavity 1 as shown in FIG. 4A. Then, the female terminal B is engaged such that the flanges 12 are in contact with the housing A just below the projections 5 and 5 as shown in FIG. 4B. In this manner, the female terminal B is caught or trapped at the flanges 12 between the projections 5 and the edge of the bottom wall 3. The female terminal B is then pivoted about the flanges 12 and 12 into the terminal-receiving cavity 1 so that the female terminal B is press-fitted into the terminal-receiving cavity 1 till the projection 6 engages the hole 13 in a snap action. At this time, the flanges 12 are conveniently trapped between the projections 5 and 5 and the edge of the bottom wall 3, so that the female terminal B will not be pushed out of the terminal-receiving cavity 1 when the female-terminal B is pushed in a press fit fashion into the terminal-receiving cavity 1. The projection 6 has beveled surfaces **6*a* and 6*a* which facilitate the press-fit of the projection 6 into the lock hole 13**.

Figure 5:
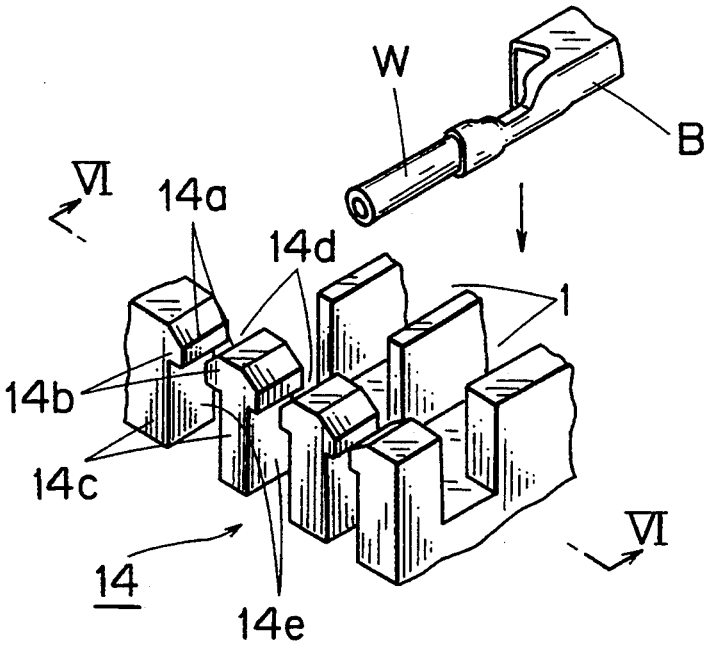
FIG. 5 is a perspective view of a wire-retainer 14 provided adjacent the longitudinal end of the terminal-receiving cavity.
Figure 6:
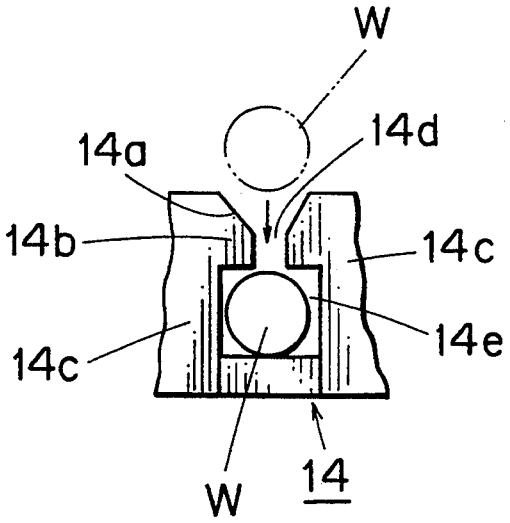
FIG. 6 is a partial cross-sectional view taken along the lines VI—VI of FIG. 5.

As shown in FIG. 5, a wire retainer 14 may be provided adjacent one longitudinal end of the terminal-receiving cavity 1 so that the wire W crimped to the female terminal B can be properly located in place. The wire retainer 14 has two resilient upright projections opposing each other. Each of the resilient projections has a top head **14*b* with a pair of beveled surfaces 14*a* so that the wire W is guided by the opposing beveled surfaces 14*a* through a narrow gap 14*d* into a wire-retaining space 14*e*** between the two adjacent projections. Since the wires W are held in the wire-retaining spaces, the female terminals B do not exert excessive forces that may cause the twisting or pull out of the female terminals B.

Figure 7:
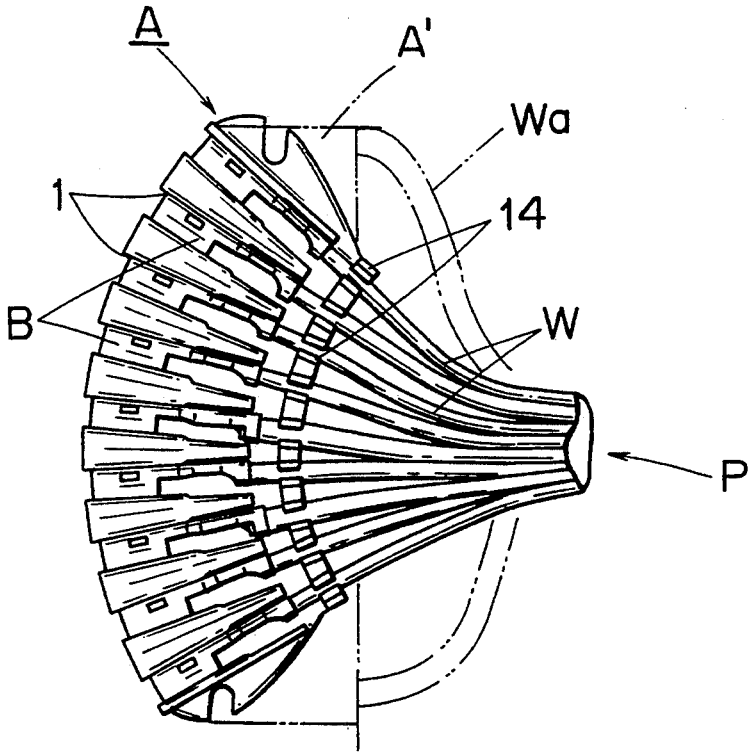
FIG. 7 is a top view of a connector according to the invention in which the female terminals are assembled into the terminal-receiving cavities with wires retained by the wire retainers 14.

FIG. 7 shows a perspective view of the connector when the female terminals B are assembled into the terminal receiving cavities 1 with wires W retained by the wire retainers 14. In FIG. 7, the wires W of female terminals B disposed in an arc are close to each other at a center P of the arc. The wires W do not spread out and are therefore space saving, while wires W*a* are straightly directed out of the housing if terminals are placed in side-by-side parallel relation and aligned in a straight line just as in a conventional housing. Upon mounting the housing A to an inhibiter switch unit, not shown, with the female terminals B assembled therein, the respective female terminals B are connected with corresponding male terminals. In the aforementioned embodiment, the connector housing A is not limited to a type where the connector is mounted to an inhibiter switch unit for an automotive vehicle but may be of any type which is connected to various electric apparatuses. Further, the housing A may be in one piece structure with an electric apparatus of various types or may be of a type which the male terminals are insert-molded. In this case, the female terminals B are electrically in contact with the male terminals C upon inserting the female terminals B.

The projections 5 and 6, the projections 12, and holes 13 may be replaced by other construction as far as the female terminal is properly locked into the terminal-receiving cavity.

Figure 8:
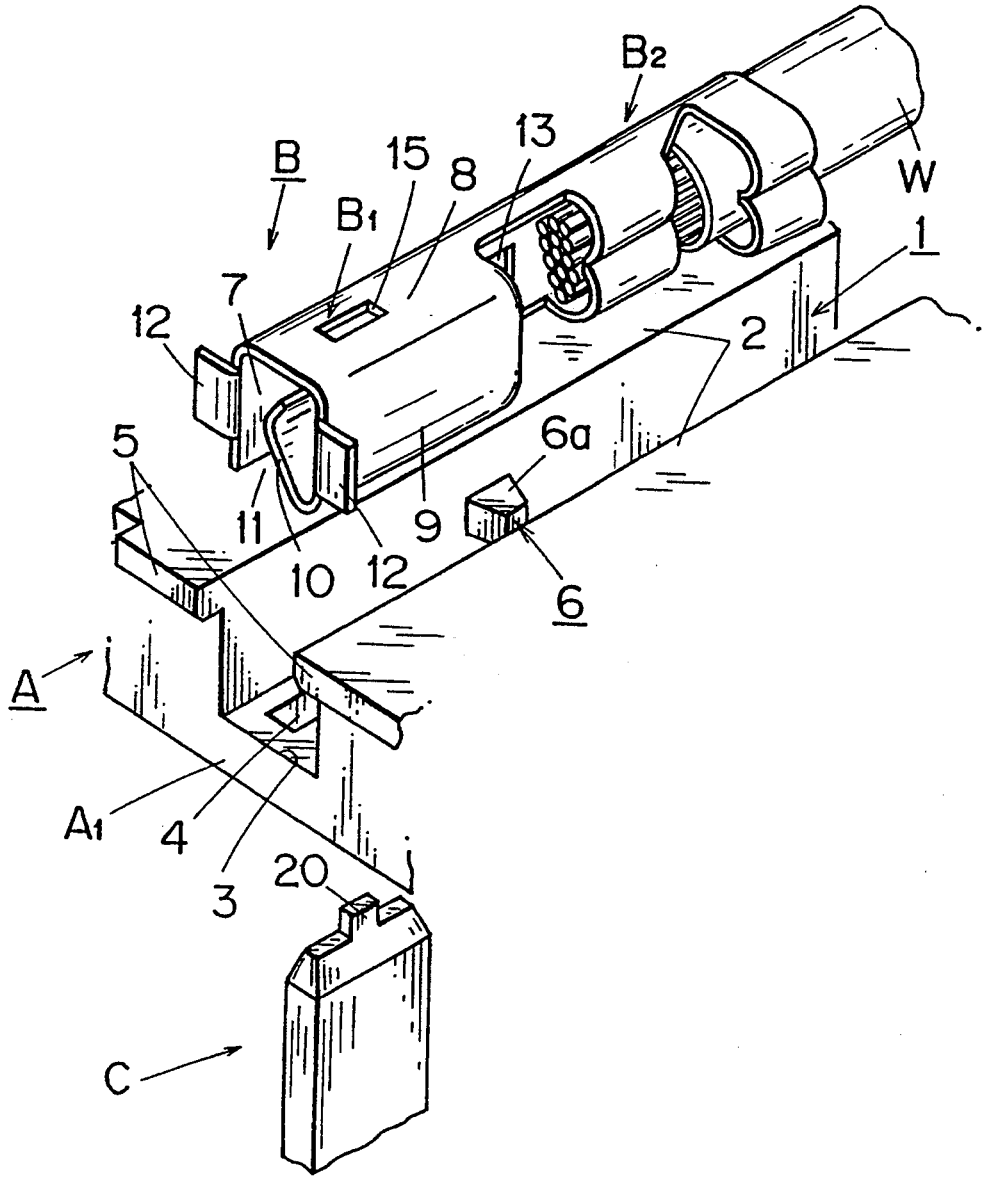
FIG. 8 shows another embodiment of a female terminal B and a male terminal C.
Figure 9A:
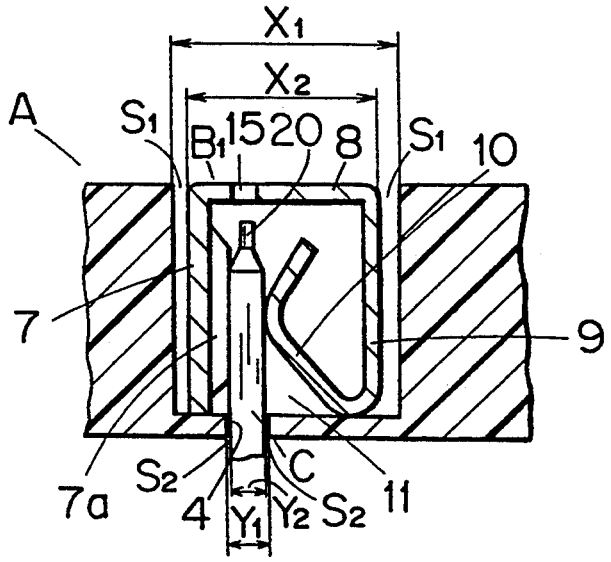
FIG. 9A and 9B are cross-sectional views of the female terminal B of FIG. 8, FIG. 9A showing the female terminal B inserted into the part way of the terminal-receiving cavity, and FIG. 9B showing the male terminal inserted fully into the terminal-receiving cavity.
Figure 9B:
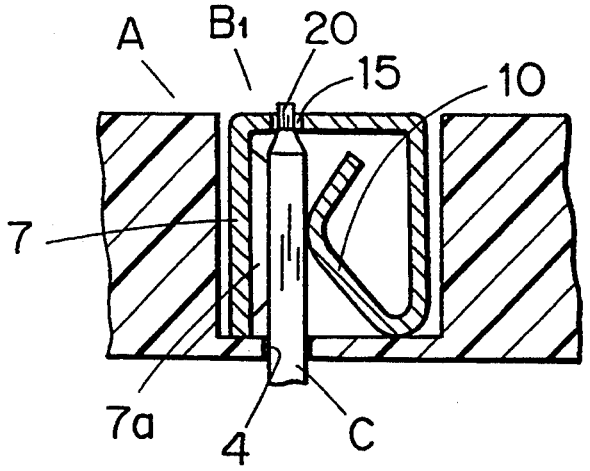

FIG. 8 shows a second embodiment of a female terminal B and a male terminal C. In the second embodiment, the female terminal B has a hole 15 while the male terminal C has a positioning end 14 at its distal end. FIG. 9A shows the female terminal inserted to the part way of the terminal-receiving cavity 1, and FIG. 9B showing the male terminal fully inserted into the connector housing A.

When the male terminal C is inserted through the opening 4 into the terminal receiving space 11, the male terminal C is urged by the resilient contact 10 against a contact surface **7*a* of the base 7. The male terminal C is then further inserted into the housing until the positioning end 14 extends into the hole 15 as shown in FIG. 9B. The male terminal C is in contact with the female contact B both at contact 10** and the edges of the hole 15. This enhances electrical contact between the male and female terminals.

Figure 10:
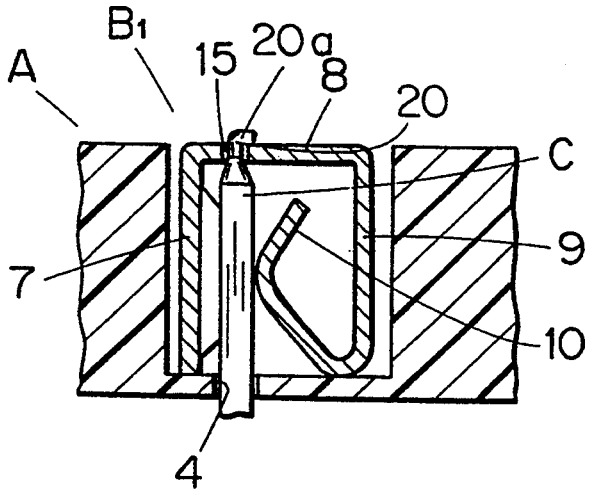
FIG. 10 shows the male terminal of FIG. 8 fully inserted into the female connector with its tip end bent.
Figure 11:
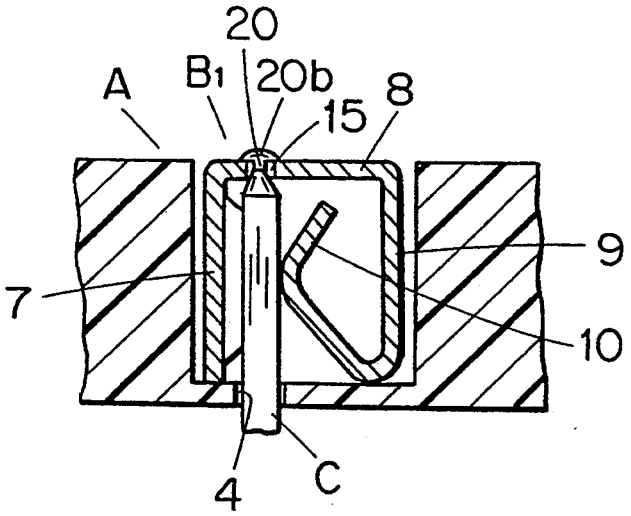
FIG. 11 shows the male terminal of FIG. 8 with its tip end caulked or soldered.
Figure 12:
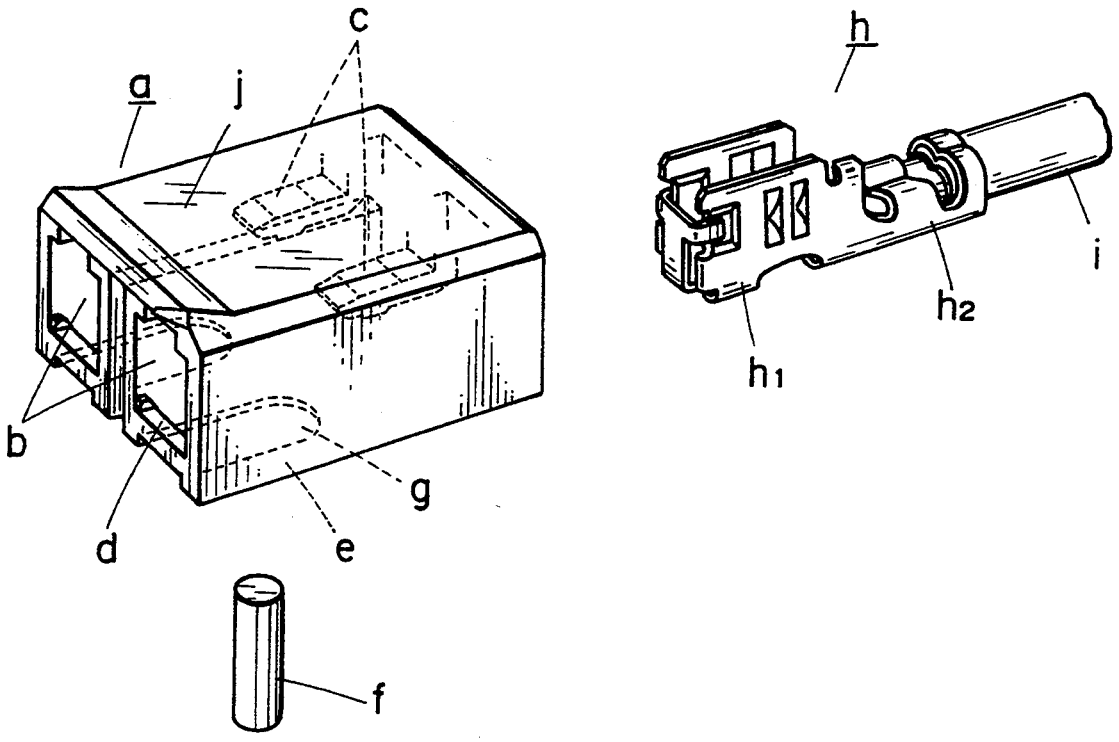
FIG. 12 is a perspective view of a prior art conventional connector and prior art female and male terminals.
Figure 13:
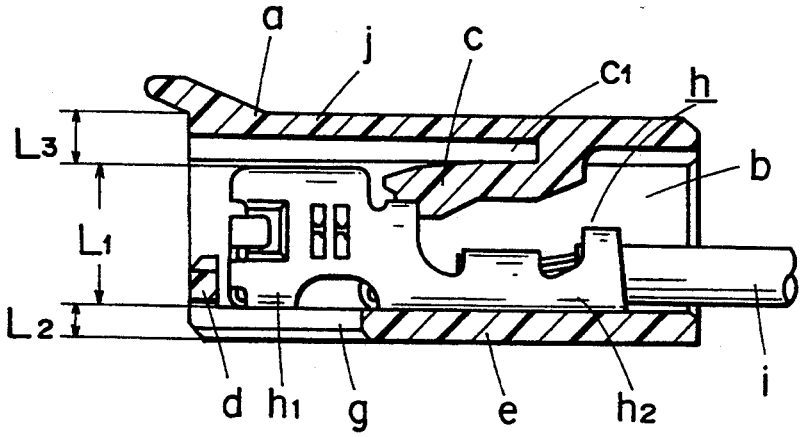
FIG. 13 is a cross-sectional view of the connector housing of FIG. 8 when the female terminal has been assembled into the connector housing.
Figure 14A:
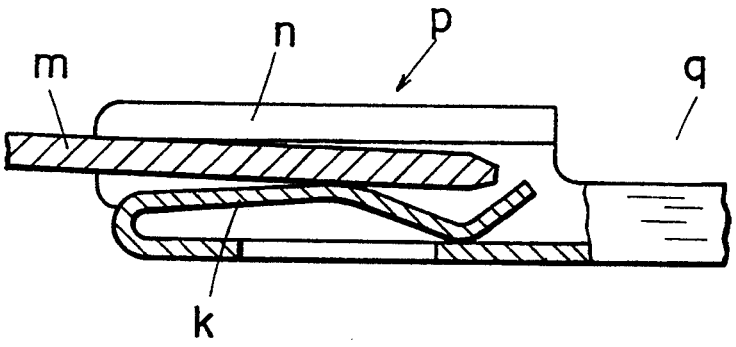
FIGS. 14A and 14B show another conventional male terminal fitted into a mating female terminal.
Figure 14B:
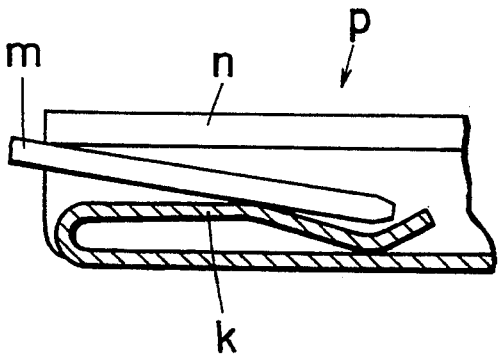

In this case, the gaps S1 and S2 allow the female terminal B and the male terminal C, respectively, to slightly move laterally for smooth insertion of male terminal C into the male terminal receiving space 11. Providing the gaps S1 and S2 is particularly advantageous when a plurality of male terminals C are simultaneously inserted through the terminal-receiving spaces 11 into the holes 15. The male terminal C engages the female connector both at the opening 4 and at the hole 15, so that the male terminal C is not subject to "rocking motion." This prevents the excessive deformation of the contact 10. The positioning end 14 may be bent as shown in FIG. 10, or may be caulked or soldered as shown in FIG. 11 for sure engagement of the male terminal C with the female terminal B, thereby preventing terminal pull out.

What is claimed is:

1. A terminal-locking construction comprising:

a housing having a groove-like terminal-receiving cavity formed therein;

a terminal retained within said terminal-receiving cavity, said terminal having a first engagement portion at a longitudinal end thereof and a second engagement portion at a longitudinally intermediate position thereof;

a third engagement portion formed externally at one longitudinal open end of said terminal-receiving cavity, said third engagement portion engaging said first engagement portion; and a fourth engagement portion formed at a longitudinally intermediate position of said terminal-receiving cavity, said fourth engagement portion engaging said second engagement portion; whereby, when assembling, said first engagement portion of said terminal is first engaged with said third engagement portion and thereafter said terminal is pivotally rotated about an engagement between said first and third engagement portions into said terminal-receiving cavity until said second engagement portion engages said fourth engagement portion.

2. A terminal-locking construction according to claim 1, wherein said second engagement portion is a hole formed in said terminal.

3. A terminal-locking construction according to claim 1, further including a wire crimped to the terminal and wherein said housing further includes a wire retainer provided adjacent one longitudinal end of said terminal-receiving cavity, whereby the wire crimped to the terminal can be properly located in place.

4. A terminal locking construction comprising:

a housing having a groove-like terminal-receiving cavity formed therein;

a terminal retained within said terminal-receiving cavity, said terminal having a first engagement portion at a longitudinal end thereof and a second engagement portion at a longitudinally intermediate position thereof;

a third engagement portion formed at one longitudinal end of said terminal-receiving cavity, said third engagement portion engaging said first engagement portion; and a fourth engagement portion formed at a longitudinally intermediate position of said terminal-receiving cavity, said fourth engagement portion engaging said second engagement portion; whereby, when assembling, said first engagement portion of said terminal is first engaged with said third engagement portion and thereafter said terminal is pivotally rotated about an engagement between said first and third engagement portions into said terminal-receiving cavity until said second engagement portion engages said fourth engagement portion, wherein said first engagement portion is a pair of flanges projecting transversely of said terminal.

5. A terminal-locking construction comprising:

a housing having a groove-like terminal-receiving cavity formed therein;

a terminal retained within said terminal-receiving cavity, said terminal having a first engagement portion at a longitudinal end thereof and a second engagement portion at a longitudinally intermediate position thereof;

a third engagement portion formed at one longitudinal end of said terminal-receiving cavity, said third engagement portion engaging said first engagement portion; and a fourth engagement portion formed at a longitudinally intermediate position of said terminal-receiving cavity, said fourth engagement portion engaging said second engagement portion; whereby, when assembling, said first engagement portion of said terminal is first engaged with said third engagement portion and thereafter said terminal is pivotally rotated about an engagement between said first and third engagement portions into said terminal-receiving cavity until said second engagement portion engages said fourth engagement portion, wherein said third engagement portion is a first projection formed on said housing, said first projection projecting outwardly of said housing.

6. A terminal-locking construction comprising:

a housing having a groove-like terminal-receiving cavity formed therein:

a terminal retained within said terminal-receiving cavity, said terminal having a first engagement portion at a longitudinal end thereof and a second engagement portion at a longitudinally intermediate position thereof;

a third engagement portion formed at one longitudinal end of said terminal-receiving cavity, said third engagement portion engaging said first engagement portion; and a fourth engagement portion formed at a longitudinally intermediate position of said terminal-receiving cavity, said fourth engagement portion engaging said second engagement portion; whereby, when assembling, said first engagement portion of said terminal is first engaged with said third engagement portion and thereafter said terminal is pivotally rotated about an engagement between said first and third engagement portions into said terminal-receiving cavity until said second engagement portion engages said fourth engagement portion, wherein said housing includes a plurality of said terminal-receiving cavities disposed side-by-side in an arcuate shape as a whole, and each of said terminal receiving cavities has a wire retainer provided adjacent one longitudinal end of said terminal-receiving cavity.

7. A terminal-locking construction comprising:

a housing having a groove-like terminal-receiving cavity formed therein;

a terminal retained within said terminal-receiving cavity, said terminal having a first engagement portion at a longitudinal end thereof and a second engagement portion at a longitudinally intermediate position thereof;

a third engagement portion formed at one longitudinal end of said terminal-receiving cavity, said third engagement portion engaging said first engagement portion; and a fourth engagement portion formed at a longitudinally intermediate position of said terminal-receiving cavity, said fourth engagement portion engaging said second engagement portion; Whereby, when assembling, said first engagement portion of said terminal is first engaged with said third engagement portion and thereafter said terminal is pivotally rotated about an engagement between said first and third engagement portions into said terminal-receiving cavity until said second engagement portion engages said fourth engagement portion, wherein said terminal-receiving cavity has two opposed walls and said fourth engagement portion is a second projection formed on one of said opposed walls.

8. A terminal-locking construction according to claim 7, wherein said second projection includes a beveled surface rising from the opposed side wall.

9. A terminal-locking construction according to claim 7, wherein said terminal is a female terminal and said terminal-receiving cavity has a bottom wall between said opposed walls, said bottom wall having formed with a first hole through which a male terminal of a mating connector extends into said female terminal for electrical contact with said female terminal.

10. A terminal-locking construction according to claim 9, wherein said female terminal further includes a second hole therein through which said male terminal extends while contacting said female terminal, whereby said male terminal is held both at said first hole and at said second hole.

11. A terminal-locking construction according to claim 10, wherein said male terminal is bent at a distal end thereof after the male terminal has been inserted into said second hole.

12. A terminal-locking construction according to claim 10, wherein said male terminal is soldered at a distal end thereof after the male terminal has been inserted into said second hole.

13. A terminal-locking construction according to claim 10, wherein said male terminal is caulked at a distal end thereof after the male terminal has been inserted into said second hole.

* * * * *